US012098712B2

(12) United States Patent
Cook

(10) Patent No.: US 12,098,712 B2
(45) Date of Patent: Sep. 24, 2024

(54) HYDRAULIC FRACTURING PUMP SYSTEM

(71) Applicant: FMC Technologies, Inc., Houston, TX (US)

(72) Inventor: James Cook, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 18/363,910

(22) Filed: Aug. 2, 2023

(65) Prior Publication Data

US 2023/0374980 A1 Nov. 23, 2023

Related U.S. Application Data

(62) Division of application No. 17/008,887, filed on Sep. 1, 2020.

(51) Int. Cl.

| | |
|---|---|
| ***F04B 23/06*** | (2006.01) |
| ***E21B 43/26*** | (2006.01) |
| ***F04B 17/00*** | (2006.01) |
| ***F04B 17/06*** | (2006.01) |
| ***F04B 23/02*** | (2006.01) |

(52) U.S. Cl.

CPC ..... *F04B 23/06* (2013.01); *E21B 43/26* (2013.01); *E21B 43/2607* (2020.05); *F04B 17/00* (2013.01); *F04B 17/06* (2013.01); *F04B 23/02* (2013.01)

(58) Field of Classification Search

CPC ..... F04B 23/06; F04B 17/00; F04B 17/06; F04B 23/02; E21B 43/26; E21B 43/2607

See application file for complete search history.

(56) References Cited

U.S. PATENT DOCUMENTS 11,066,915 B1 * 7/2021 Yeung ..... E21B 43/2607
2019/0331100 A1 * 10/2019 Gable ..... F04B 51/00

* cited by examiner

*Primary Examiner* — James G Sayre

(74) *Attorney, Agent, or Firm* — Osha Bergman Watanabe & Burton LLP

(57) ABSTRACT

A modular pump skid includes a base, a prime mover mounted on the base, and one or more hydraulic pump circuits removably mounted on the base and operationally coupled to the prime mover, wherein each hydraulic pump circuit has a hydraulic pump operationally coupled to the prime mover and a hydraulically driven pump fluidly coupled to the hydraulic pump. Each hydraulic pump circuit is in a closed loop independent of other hydraulic pump circuits.

18 Claims, 8 Drawing Sheets

HYDRAULIC FRACTURING PUMP SYSTEM

CROSS-REFERENCE TO RELATED APPLICATIONS

This application is a divisional application of and claims benefit under 35 U.S.C. § 120 to U.S. patent application Ser. No. 17/008,887, filed on Sep. 1, 2020, which is incorporated by reference herein in its entirety.

BACKGROUND

Hydraulic fracturing is a stimulation treatment routinely performed on oil and gas wells in low-permeability reservoirs. Specially engineered fluids are pumped at high pressure and rate into a reservoir interval to be treated, causing a vertical fracture to open. The wings of the fracture extend away from the wellbore in opposing directions according to the natural stresses within the formation. Proppant, such as grains of sand of a particular size, is mixed with the treatment fluid to keep the fracture open when the treatment is complete. Hydraulic fracturing creates high-conductivity communication with a large area of formation and bypasses any damage that may exist in the near-wellbore area. Furthermore, hydraulic fracturing is used to increase the rate at which fluids, such as petroleum, water, or natural gas can be recovered from subterranean natural reservoirs. Reservoirs are typically porous sandstones, limestones or dolomite rocks, but also include "unconventional reservoirs" such as shale rock or coal beds. Hydraulic fracturing enables the extraction of natural gas and oil from rock formations deep below the earth's surface (e.g., generally 2,000-6,000 m (5,000-20,000 ft)), which is greatly below typical groundwater reservoir levels. At such depth, there may be insufficient permeability or reservoir pressure to allow natural gas and oil to flow from the rock into the wellbore at high economic return. Thus, creating conductive fractures in the rock is instrumental in extraction from naturally impermeable shale reservoirs.

A wide variety of hydraulic fracturing equipment is used in oil and natural gas fields, such as a slurry blender, one or more high-pressure, high-volume fracturing pumps and a monitoring unit. Additionally, associated equipment includes fracturing tanks, one or more units for storage and handling of proppant, high-pressure treating iron, a chemical additive unit (used to accurately monitor chemical addition), low-pressure flexible hoses, and many gauges and meters for flow rate, fluid density, and treating pressure. Fracturing equipment operates over a range of pressures and injection rates, and can reach up to 100 megapascals (15,000 psi) and 265 liters per second (9.4 cu ft/s) (100 barrels per minute).

As seen in FIG. 1, FIG. 1 illustrates an example of an existing hydraulic fracturing pad system 100 (often referred to as a "frac pad" in the industry). The fracturing pad system 100 includes at least one pump truck 102 connected to a missile manifold 104 via fluid connections 106. Additionally, a blending system 108 may be connected to the pump trucks 102 through one or more hoses 110 to supply proppant and other particulates to the pump trucks 102 to pump into the well (through wellheads W) as part of the fracturing process. The missile manifold 104 may be connected to a valve structure 112 that, for instance, can include a safety valve that may open to relieve pressure in the system under certain conditions. The valve structure 112 may be connected to at least one manifold 114 through a pipe spool 116 that is a plurality of pipes flanged together, for instance. As can be seen from FIG. 1, the fracturing pad system 100 includes many, non-uniform connections that must be made up and pressure tested, including the conduits to/from the pump trucks 102, missile manifold 104, and blending system 108. Furthermore, the connections between the missile manifold 104 and valve structure 112, and the pipe spool 116 between the valve structure 112 and the manifolds 114 are also non-uniform connections that must be made up and pressure tested. These connections take valuable time and resources on site. Additionally, the fracturing pad system 100 is generally not flexible regarding the number of pumps that can be used.

As seen in FIG. 2, FIG. 2 illustrates an example of existing pump trucks 102 in an open loop circuit. The pump trucks 102 may include a motor 102*a* operationally coupled to a pump 102*b*. As can be seen from FIG. 2, the pump trucks 102 may be powered by a singular power source 103 with a turbine or engine 103*a* operationally coupled to a generator 103*b*. Now referring to FIG. 3, FIG. 3 illustrates a schematic diagram of the existing pump truck 102 in the open loop circuit. The pump 102*b* may have an inlet fluidly coupled to the one or more hoses 110 and an outlet fluidly coupled to the fluid connections 106. The fluid connections 106 may be fluidly coupled to the wellhead W, and the one or more hoses 110 may be fluidly coupled to the blending system 108. Additionally, the pump truck 102 may incorporate a control valve 105 to operate the pump 102*b*. The control valve 105 may be fluidly coupled to the turbine or engine 103*a* to power the pump 102*b*. Further, a tank 111 may be fluidly coupled to the control valve 105 to recirculate excess pressure from the turbine 103*a* via a pump and form the open loop circuit. The open loop circuit shown in FIGS. 2 and 3 requires constant pressure relief to discharge fluids as fluids are constantly circulating. Additionally, if any components of the pump truck 102 fails within the open loop circuit, the entire system fails and must be shut down for repairs. For example, if any pressure containing failure occurs between the turbine or engine 103*a* and the control valve 105, the entire unit must shut down. This entire unit shut down is due to an open loop circuit, as the pump truck 102 is generating excess hydraulic power all the time and taking some excess hydraulic power via the control valve 105 to divert to the pump 102*b*.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to modular pump skids including a base, a prime mover mounted on the base, and one or more hydraulic pump circuits removably mounted on the base and operationally coupled to the prime mover, wherein each hydraulic pump circuit has a hydraulic pump operationally coupled to the prime mover and a hydraulically driven pump fluidly coupled to the hydraulic pump. The hydraulic pump and the hydraulically driven pump may form a closed loop hydraulic pump circuit, where each hydraulic pump circuit may be independent of other hydraulic pump circuits.

In another aspect, embodiments disclosed herein relate to systems that include one or more modular pump skids having a prime mover mounted on a base and one or more hydraulic pump circuits removably mounted on the base and operationally coupled to the prime mover. Each hydraulic pump circuit may include a hydraulic pump and a hydraulically driven pump fluidly coupled to the hydraulic pump, wherein each hydraulic pump circuit is in a closed loop independent of other hydraulic pump circuits. One or more high-pressure fluid conduits may be coupled to the hydraulically driven pump, and a fluid manifold may be coupled to a well, wherein the one or more high-pressure fluid conduits are fluidly coupled to the fluid manifold. The hydraulically driven pump may be configured to inject fluids into the well.

In yet another aspect, embodiments disclosed herein relate to methods that include independently powering at least two hydraulic pump circuits on a modular pump skid with a single prime mover mounted on the modular pump skid, wherein each hydraulic pump circuit comprises a hydraulic pump and a hydraulically driven pump fluidly coupled to the hydraulic pump, providing horsepower, with the prime mover, to each hydraulic pump of the hydraulic pump circuits, redistributing an unused horsepower, when one of the at least two hydraulic pump circuits breaks down, to one or more operating hydraulic pump circuits, flowing a fluid from the hydraulically driven pump to a high-pressure fluid conduit, and injecting the fluid into a well via a fluid manifold fluidly coupled to the high-pressure fluid conduit.

Other aspects and advantages will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
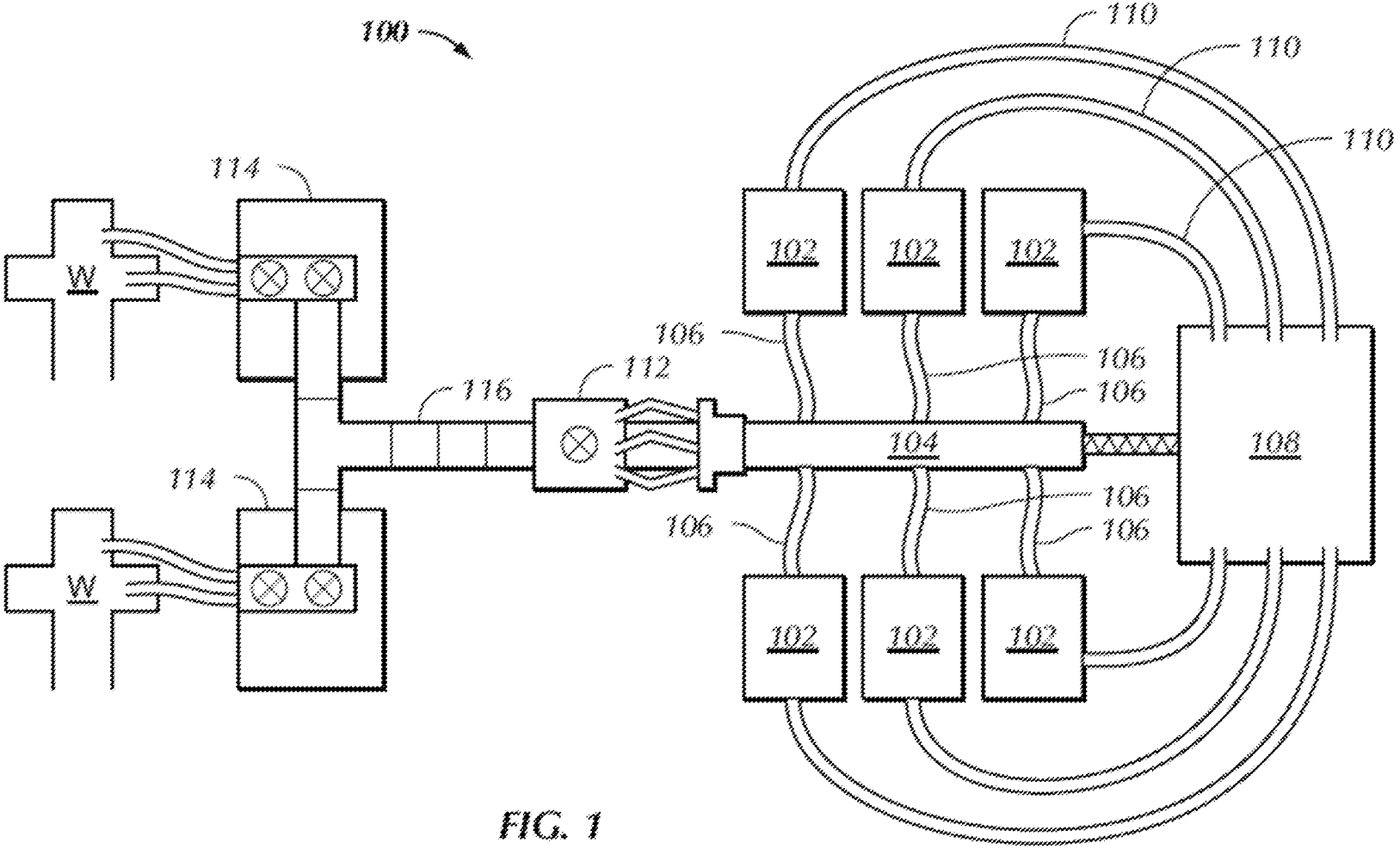
FIG. 1 (Prior Art)
FIGS. 1-3 are block diagrams of an example of a conventional hydraulic fracturing pad system.
Figure 2:
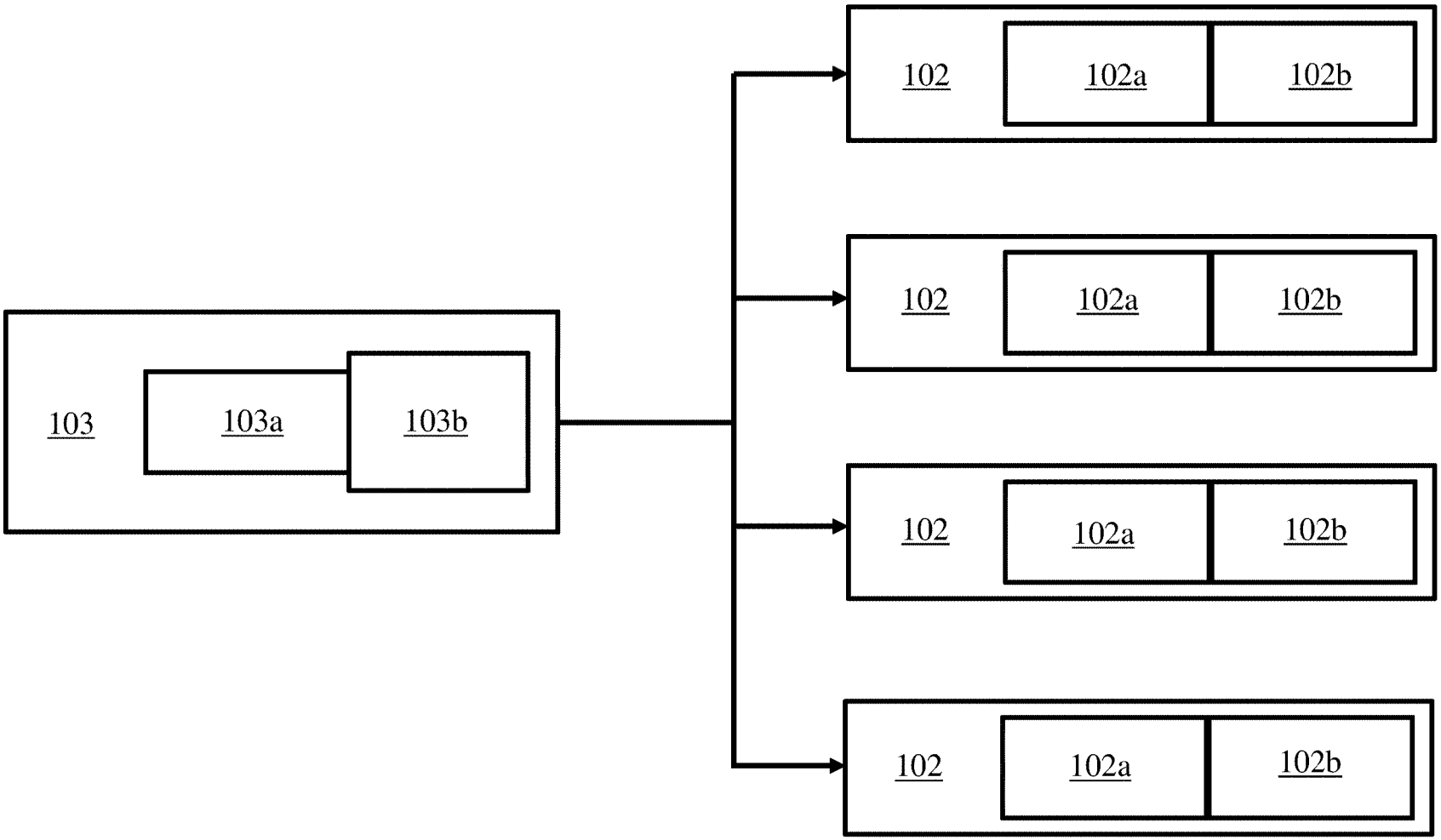
FIG. 2 (Prior Art)
Figure 3:
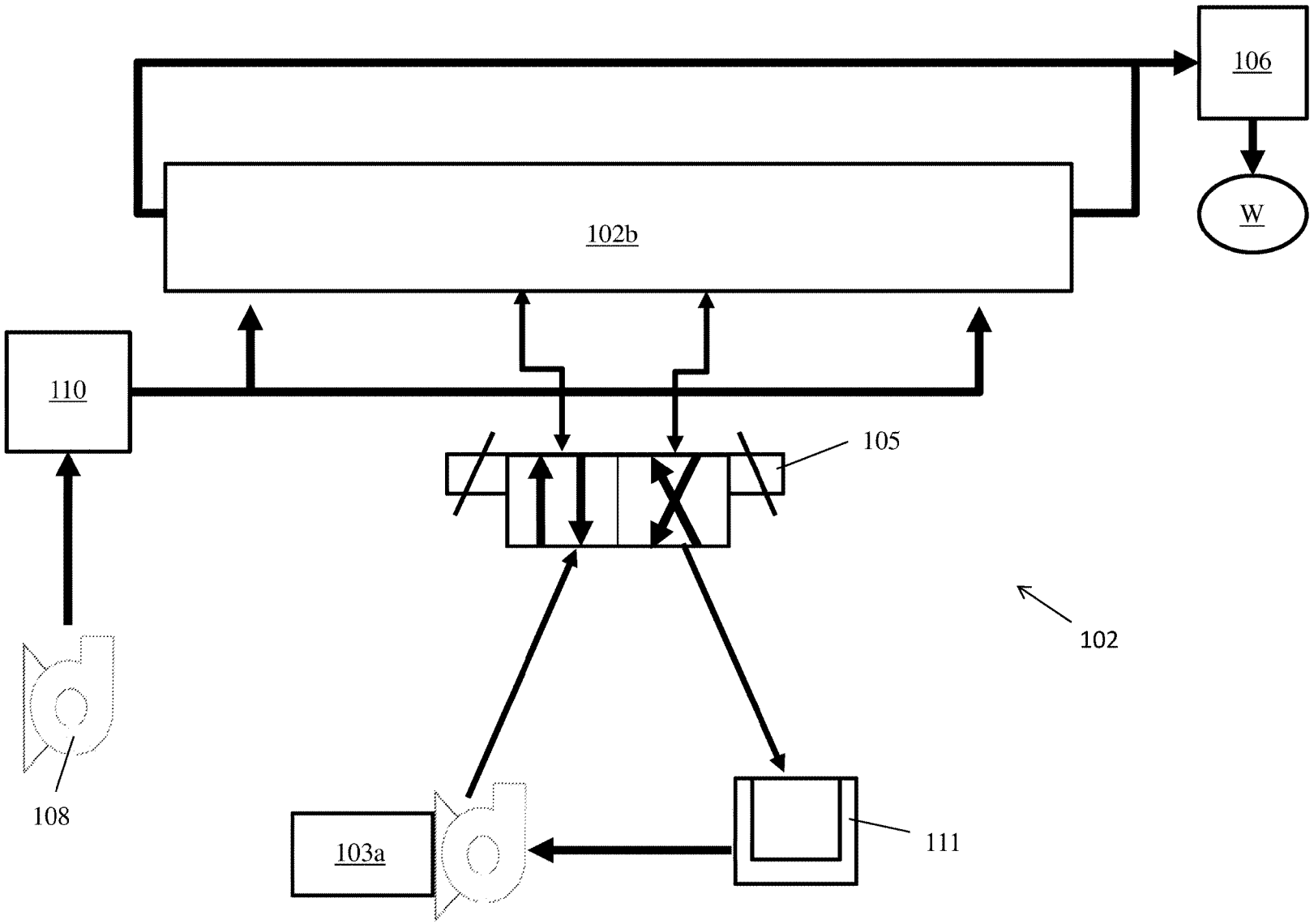
FIG. 3 (Prior Art)

In one aspect, embodiments disclosed herein relate to a modular fracturing pump pad system. The modular fracturing pump pad system may also be interchangeably referred to as a modular pump skid system in the present disclosure. As used herein, the term "coupled" or "coupled to" or "connected" or "connected to" may indicate establishing either a direct or indirect connection and is not limited to either unless expressly referenced as such.

A modular pump skid system, according to embodiments herein, may refer to a system in which the elements of hydraulic fracturing pumps are modularized and deployed on connectable modular skids that can be secured together to a well site to form interchangeable hydraulic fracturing pumps in a closed loop. The modular pump skid system elements may be modularized in a way such that the conduit manifolds/flow functionality is made up when the modular pump skid systems are connected in the closed loop. Further, the modular pump skid system elements may be held on units having standardized uniform connections, such that different types of pump element units may be connected together using the same connection type. The reduction of using non-uniform connections that must be made up and pressure tested may significantly reduce the complexity, design, time, and weight of the system. Additionally, the modular pump skid system may be used to direct fluid produced from or injected into a well.

In some embodiments, a modular pump skid may be loaded onto a base and connected to other modular pump skids. Additionally, each modular pump skid may have multiple hydraulic pump circuits held on the modular pump skid, where each hydraulic pump circuit may be in a closed loop. The hydraulic pump circuits may include a hydraulic pump fluidly coupled to a hydraulically driven pump to form the closed loop. In such embodiments, the base holding various components of the fracturing pump may be transported to a wellsite such that the equipment on the base (e.g., fluid conduits, pumps, valve manifolds, etc.) may all be pre-rigged and dropped on location in rigged-up condition. By using modular pump skids according to embodiments of the present disclosure for hydraulic fracturing wellbore operations, equipment may be pre-rigged and dropped on location in any condition, including ready-to-use, thereby reducing installation time in the field. According to embodiments of the present disclosure, a modular pump skid may include piping or a body having one or more flow paths formed therethrough to interconnect with other modular pump skids or a fluid manifold. As used herein, fluids may refer to proppant, frac fluids, liquids, gases, and/or mixtures thereof. Other instruments and devices, including without limitation, sensors and various valves may be incorporated within a modular fracturing pump pad system.

Conventional hydraulic fracturing pumps in the oil and gas industry typically consume a large amount of space and resources of a rig area. Conventional hydraulic fracturing pumps may use elements that are individually designed and sized with pipes, flow lines, diesel engines, and other conduits being used to interconnect the conventional hydraulic fracturing pumps to fracturing operations. Furthermore, pipes, flow lines, and other conduits being used to interconnect the conventional hydraulic fracturing pumps are not uniform and take valuable time to make up and pressure test. Additionally, the sheer number of pipes, hoses, and other fluid connections represent safety hazards for on-site workers. These additional components needed to interconnect the conventional hydraulic fracturing pumps adds to the weight, installation costs, and overall cost of the conventional hydraulic fracturing pumps. However, using modular pump skids according to one or more embodiments of the present disclosure may overcome such challenges, as well as provide additional advantages over conventional fracturing pumps.

Figure 4:
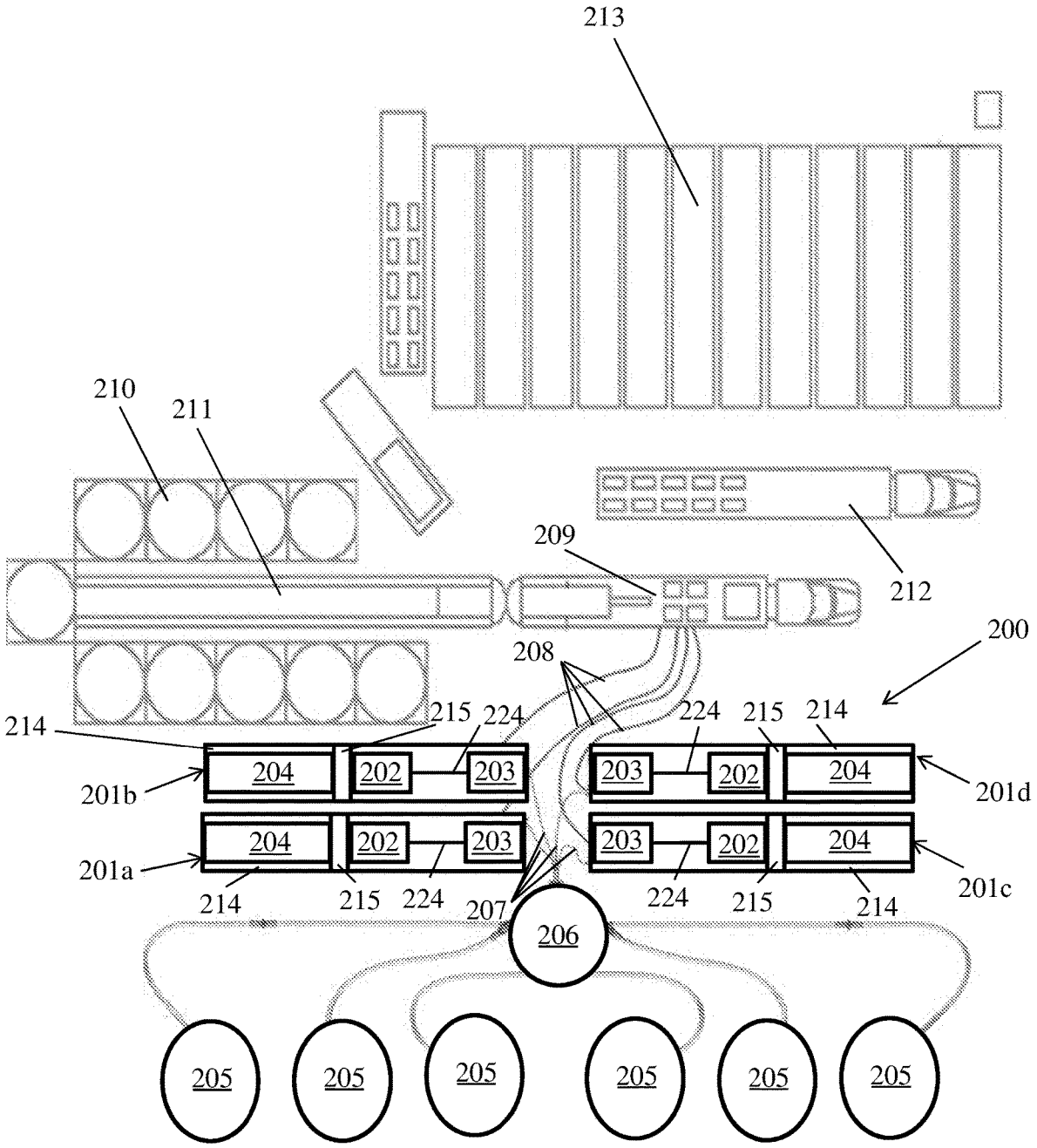
FIG. 4 illustrates a schematic view of a modular fracturing pump system in accordance with one or more embodiments of the present disclosure.

Referring to FIG. 4, in one or more embodiments, FIG. 4 illustrates a modular pump skid system 200 at a well site. The modular pump skid system 200 may include one or more modular pump skids 201*a*, 201*b*, 201*c*, 201*d*. While it is noted that four modular pump skids are shown, this is merely for example purposes only and any number of modular pump skids may be used without departing from the scope of the present disclosure.

Each modular pump skid 201*a*, 201*b*, 201*c*, 201*d* may have one or more hydraulic pump circuits (202, 203) removably disposed on a base or chassis 214. As used herein, a hydraulic pump circuit may refer to a set of fluidly connected pumps, including a hydraulic pump 202 and a hydraulically driven pump 203, and connections 224 between the pumps (202, 203). The hydraulically driven pump 203 may be, for example, a dual acting long stroke cylinder pump, or a hydraulic motor driving a traditional reciprocating plunger pump, or various other types of reciprocating plunger or piston pumps. The connections 224 between the hydraulic pump 202 and the hydraulically driven pump 203 may be fluid conduits such as hydraulic lines or hoses.

Additionally, each of the modular pump skids 201*a*, 201*b*, 201*c*, 201*d* may include a prime mover 204, such as a turbine or engine, mounted on the base and operationally coupled to the hydraulic pump circuits (202, 203) via an optional pump drive 215, such as a gearbox. A fuel supply (not shown) may feed directly into the prime mover 204. Multiple hydraulic pump circuits (202, 203) may be provided on each of the modular pump skids 201*a*, 201*b*, 201*c*, 201*d* in a closed loop, such that if one hydraulic pump circuit (202, 203) fails or is otherwise shut down, the other hydraulic pump circuits (202, 203) may continue to operate.

The closed loop may be formed by the hydraulic pump 202 fluidly coupled to the hydraulically driven pump 203 such that fluid is circulated between the hydraulic pump 202 and the hydraulically driven pump 203. In conventional open loop systems, once fluids are used at the hydraulic driven pump, the fluids are dumped into a tank and are not returned to the non-discharge side of the hydraulic pump. As such, the closed loop hydraulic pump circuits may use less fluid than open loop systems. However, in some embodiments, a closed loop hydraulic pump circuit may spend small amounts of fluid for heating/cooling purposes. For example, the closed loop systems formed by the hydraulic pump 202 and the hydraulically driven pump 203 may have flushing circuits that feed into the low pressure side of the hydraulic pump 202 to help trade hot and cold oil out of the hydraulic pump circuit (202, 203) as heat builds over time. Further, the power from the prime mover 204 that was going to the downed hydraulic pump circuit (202, 203) may be redistributed to the remaining operating hydraulic pump circuits (202, 203) on the respective modular pump skid (201*a*, 201*b*, 201*c*, 201*d*).

In some embodiments, the closed loop hydraulic pump circuits may use a hydraulic pump with a swash plate to dictate the flow to the hydraulically driven pump. In such embodiments, the swash plate may be moved to a selected position to allow an amount of fluid flow between the pumps. In contrast, open loop systems may use control valves that choke off flow to the hydraulically driven pump. Thus, hydraulic pumps in open loop system may provide fluid flow and pressure to the hydraulically driven pump, but offer less control than a pump in the closed loop hydraulic pump circuits using a swash plate.

In some embodiments, the modular pump skids 201*a*, 201*b*, 201*c*, 201*d* may be coupled to at least one wellhead 205 by using a manifold skid 206. The manifold skid 206, in some embodiments, refers to a modular skid that is purpose built for connection to the wellhead 205, and may include an outlet head (which may be referred to as a fracturing head or goat head in fracturing operations) for connection to the wellhead 205 and one or more gate valves. It is further envisioned that the modular pump skids 201*a*, 201*b*, 201*c*, 201*d* may be coupled directly to the wellhead 205 without the manifold skid 206. For example, flow lines from the modular pump skids 201*a*, 201*b*, 201*c*, 201*d* may be coupled to the outlet head for connection to the wellhead 205 and may include one or more gate valves.

In one or more embodiments, a frac blender 209 may provide hydraulic blended pressure (e.g., 100-120 PSI) to low-pressure fluid conduits 208 to each of the modular pump skids 201*a*, 201*b*, 201*c*, 201*d*, which may then be distributed to the hydraulically driven pumps 203. For example, silos 210 may provide sand to the frac blender 209 via a conveyor belt 211. In addition, one or more water and chemical storage units 213 may feed a fluid (water with or without chemicals) to either a hydration unit 212 and/or directly to the frac blender 209. The frac blender 209 may then mix the sand from the silos 210 and the fluids from the one or more water and chemical storage units 213 to form a fracturing fluid to pump into the wellhead 205. From the hydraulically driven pumps 203, a treated pressure (e.g., 15*k* PSI) may exit the modular pump skids 201*a*, 201*b*, 201*c*, 201*d* through high-pressure fluid conduits 207. The high-pressure fluid conduits 207 of each modular pump skids 201*a*, 201*b*, 201*c*, 201*d* may be in fluid communication with the manifold skid 206. For example, the high-pressure fluid conduits 207 may inject fluids into or receive fluids from the manifold skid 206. Each high-pressure fluid conduit 207 may be integrated with the base of the modular pump skids 201*a*, 201*b*, 201*c*, 201*d*.

Figure 5:
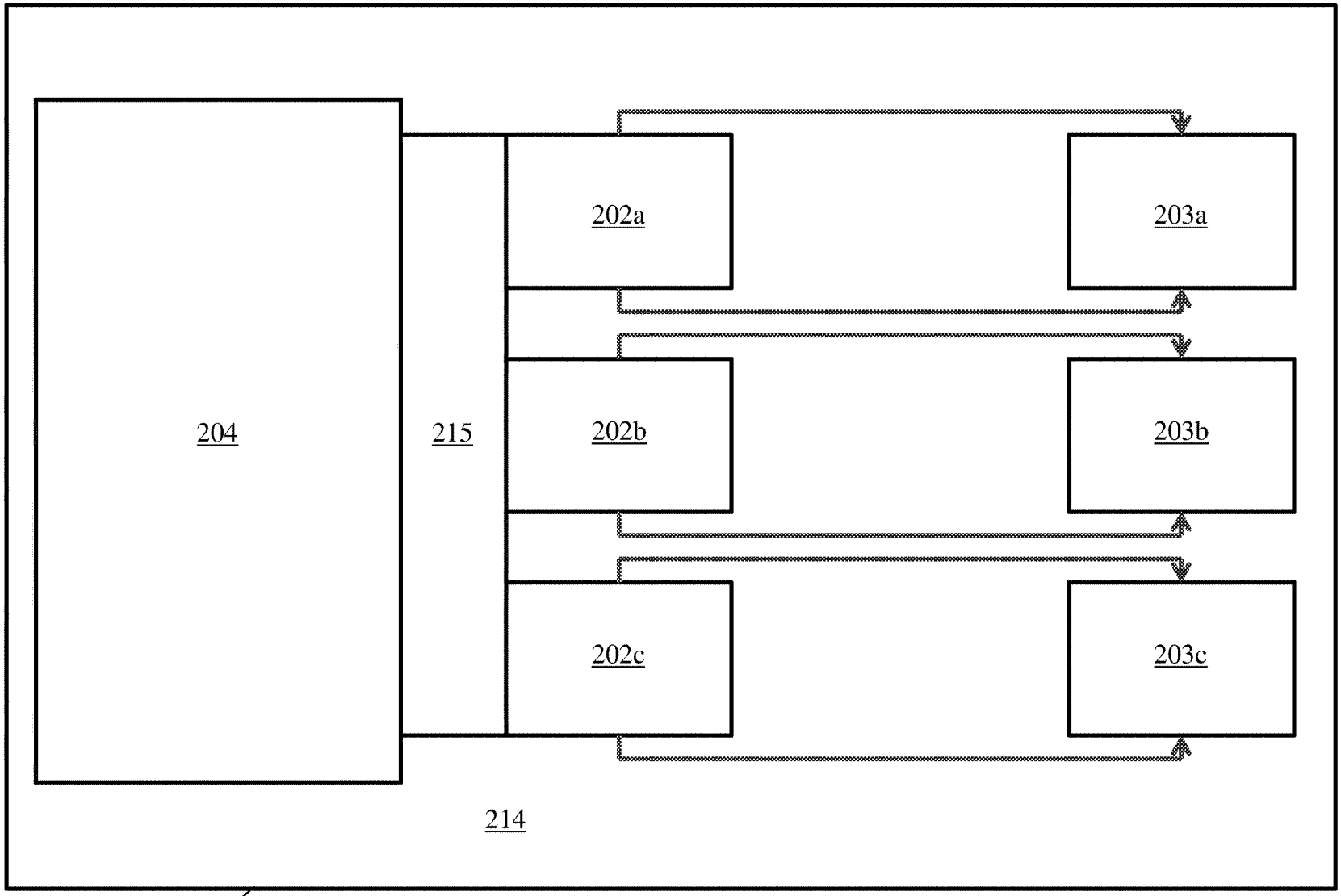
FIG. 5 illustrates a schematic view of a modular pump skid of the modular fracturing pump system of FIG. 4 in accordance with one or more embodiments of the present disclosure.

In one or more embodiments, each of the modular pump skids 201*a*, 201*b*, 201*c*, 201*d* may be placed adjacent to each other to create a more compact work site for a smaller footprint. Each of the modular pump skids 201*a*, 201*b*, 201*c*, 201*d* may be include closed loop systems formed by individual hydraulic pumps (202*a*-202*c*) fluidly coupled to hydraulically driven pumps (203*a*-203*c*). A schematic example of a modular pump skid 201 in a closed loop is illustrated in FIG. 5. The various components of the modular pump skid 201 may be all removably mounted on a single base or chassis 214. As shown by FIG. 5, a pump drive 215, such as a gearbox, may be provided on the base or chassis 214. The pump drive 215 may be operationally coupled to the prime mover 204 and the hydraulic pump circuits, e.g., first hydraulic pump circuit 202*a*, 203*a*, second hydraulic pump circuit 202*b*, 203*b*, and third hydraulic pump circuit 202*c*, 203*c*. For example, the pump drive 215 may include one inlet gear coupled to the prime mover 204 and a corresponding number of outlet gears coupled to the hydraulic pump circuits (202*a*-202*c* and 203*a*-203*c*). The pump drive 215 may have an outlet gear for each hydraulic pump circuit (e.g., a first outlet coupled to the first hydraulic pump circuit 202*a*, 203*a*, a second outlet coupled to the second hydraulic pump circuit 202*b*, 203*b*, and a third outlet coupled to the third hydraulic pump circuit 202*c*, 203*c*) within the modular pump skid 201. The pump drive 215 may be used as a rotation per minute ("RPM") reducer from the prime mover 204 to the hydraulic pump circuits (202*a*-202*c* and 203*a*-203*c*).

Still referring to FIG. 5, in one or more embodiments, the modular pump skid 201 may include one or more individual hydraulic pump circuits (202*a*-202*c* and 203*a*-203*c*)

coupled to the pump drive 215. For example, a first hydraulic pump circuit may include a first hydraulic pump 202*a* and a first hydraulically driven pump 203*a* fluidly coupled together, a second hydraulic pump circuit may include a second hydraulic pump 202*b* and a second hydraulically driven pump 203*b* fluidly coupled together, and a third hydraulic pump circuit may include a third hydraulic pump 202*c* and a third hydraulically driven pump 203*c* fluidly coupled together. Each of the hydraulic pumps (202*a*, 202*b*, 202*c*) may control the single corresponding hydraulically driven pump (203*a*, 203*b*, 203*c*) in the closed loop setup. For example, the first hydraulic pump 202*a* may drive the corresponding first hydraulically driven pump 203*a* in the first hydraulic pump circuit 202*a*, 203*a*, while the second hydraulic pump 202*b* may drive the corresponding second hydraulically driven pump 203*b* in the second hydraulic pump circuit 202*b*, 203*b*, and the third hydraulic pump 202*c* may drive the corresponding third hydraulically driven pump 203*c* in the third hydraulic pump circuit 202*c*, 203*c*. While it is noted that three individual hydraulic pump circuits are shown, this is merely for example purposes only and any number of individual hydraulic pump circuits may be used without departing from the scope of the present disclosure.

The prime mover 204 may be used to power all the individual hydraulic pump circuits (202*a*-202*c* and 203*a*-203*c*) on the modular pump skid 201. With the individual hydraulic pump circuits (202*a*-202*c* and 203*a*-203*c*) being a closed loop, a redundancy may be provided in case one of the individual hydraulic pump circuits breaks down, as the unused power from that individual hydraulic pump circuit may be shifted to the remaining operational hydraulic pump circuits, and fracturing operations may continue. For example, if the first individual hydraulic pump circuit (202*a*, 203*a*) goes down, the second individual hydraulic pump circuit (202*b*, 203*b*) and the third individual hydraulic pump circuit (202*c*, 203*c*) may continue operate without a loss in power and efficiency. Further, the downed first individual hydraulic pump circuit may be simultaneously repaired while the second individual hydraulic pump circuit (202*b*, 203*b*) and the third individual hydraulic pump circuit (202*c*, 203*c*) continue to operate. Once the downed first individual hydraulic pump circuit is repaired, the first individual hydraulic pump circuit may be turned on and operate without stopping the operations of the second individual hydraulic pump circuit (202*b*, 203*b*) and the third individual hydraulic pump circuit (202*c*, 203*c*).

Additionally, a lost horsepower ("HP") from the first hydraulic pump circuit (202*a*, 203*a*) being down may be redistributed by the prime mover 204 to the second hydraulic pump circuit (202*b*, 203*b*) and the third hydraulic pump circuit (202*c*, 203*c*). For example, if the modular pump skid 201 has five hydraulic pump circuits running at 2000 HP each (i.e., 10*k* total HP) from the prime mover 204 and one hydraulic pump circuit goes down, the prime mover 204 may automatically or manually redistribute the 2000 HP from the downed hydraulic pump circuit to the other four operational hydraulic pump circuits such that the remaining four operational hydraulic pump circuits may operate at 2500 HP. This setup has the advantage of maximizing the use of the prime mover 204 output HP while also allowing for the prime mover 204 to run at a fixed speed.

Figure 6:
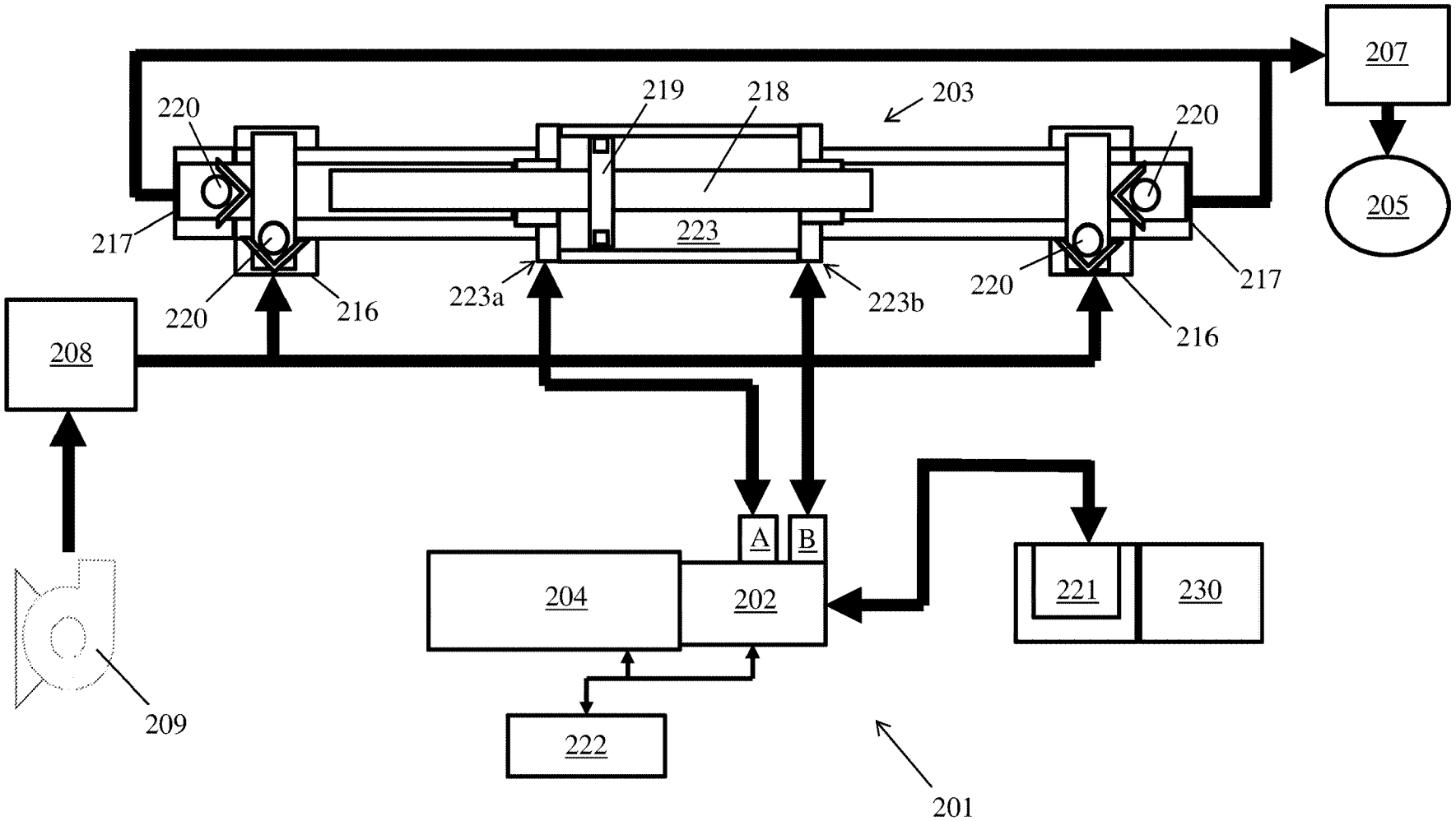
FIG. 6 illustrates a schematic view of a closed loop hydraulic pump system of the modular fracturing pump system of FIG. 4 in accordance with one or more embodiments of the present disclosure.

Now referring to FIG. 6, in one or more embodiments, FIG. 6 illustrates a schematic example of an individual hydraulic pump circuit of a modular pump skid 201 in a closed loop. The hydraulic pump circuit may include a hydraulically driven pump 203 fluidly coupled to a hydraulic pump 202 to form the closed loop. The hydraulic pump 202 in the hydraulic pump circuit may be powered by a single prime mover 204, e.g., a turbine, diesel engine, or electric motor. The hydraulically driven pump 203 may be a dual acting long stroke cylinder with a plunger 218 and piston 219 configuration. While it is noted that the hydraulically driven pump 203 is illustrated as a dual acting long stroke cylinder, this is merely for example purposes only and the hydraulically driven pump 203 may be a hydraulic motor driving a traditional reciprocating plunger pump, or various other types of reciprocating plunger or piston pumps without departing from the scope of the present disclosure. A movement of the piston 219 and the plunger 218 may be delimited by a piston chamber 223. The piston 219 may be fixed to the plunger 218 such that the plunger 218 moves as the piston 219 is actuated within the piston chamber 223. The movement of the piston 219 and the plunger 218 may occur due to discharging fluids on one side of the piston chamber 223 while simultaneously having a suction stroke on the other side of the piston chamber 223. In some embodiments, the plunger 218 may be fixed such that the piston 219 moves about an axis of the plunger 218. Additionally, the hydraulically driven pump 203 may have one or more inlets 216 fluidly coupled to a low-pressure fluid conduit 208 and one or more outlets 217 fluidly coupled to a high-pressure fluid conduit 207. The high-pressure fluid conduit 207 may be fluidly coupled to a wellhead 205 and the low-pressure fluid conduit 208 may be fluidly coupled to a frac blender 209. Further, both the one or more inlets 216 and the one or more outlets 217 may each have a valve 220 to control a fluid exiting and entering the low-pressure fluid conduit 208 and the high-pressure fluid conduit 207. The valves 220 may be, for example, check valves, fluid end valves, seat assemblies, or various other types of fluid control valves.

In one or more embodiments, the hydraulic pump 202 is fluidly coupled to the hydraulically driven pump 203. For example, a first side 223*a* of the piston chamber 223 may be connected to a first side A of the hydraulic pump 202 and a second side 223*b* of the piston chamber 223 may be connected to a second side B of the hydraulic pump 202. In the closed loop, the first side A and the second side B of the hydraulic pump 202 may trade as inlets and outlets during operations. As the prime mover 204 powers the hydraulic pump 202, the hydraulic pump 202 may direct fluids between the first and second sides 223*a*, 223*b* of the piston chamber 223 to move the piston 219 and plunger 218 configuration and drive the hydraulically driven pump 203. For example, if fluids are discharging out of the first side A of the hydraulic pump 202 to the hydraulically driven pump 203, the second side B of the hydraulic pump 202 is receiving fluids from the hydraulically driven pump 203 as an inlet/suction. Additionally, once the piston 219 and plunger 218 configuration reaches the end of the stroke, the hydraulic pump 202 operation may switch such that the second side B is now discharging fluids, while the first side A is the inlet/suction. In such manner, fluid flow is maintained in a closed loop system between the hydraulic pump 202 and the hydraulically driven pump 203.

A tank 221 may be fluidly coupled to the hydraulic pump 202 to bleed off any excess hydraulic pressure from the hydraulic pump circuit (202, 203). The tank 221 may also provide fluids to the hydraulic pump 202 while receiving any discharge fluid from the closed loop (e.g., overpressure, circulation of hot fluid from the system, etc.). The tank 221 may be a hydraulic excess tank that does not recirculate hydraulic pressure to the hydraulically driven pump 203. It is further envisioned that a cooling circuit (e.g., radiator)

may be coupled to the tank 221 to aid in keeping the fluids and the closed loop operating at the desired temperatures.

The hydraulic pump 202 or the prime mover 204 may incorporate a control valve and have a control system 222 to operate the various components of the modular pump skid 201. The control system 222 may be a computing system (e.g., as described below with reference to FIG. 8) coupled to a controller to automatically operate the modular pump skid 201. By using the control system 222, the control valve of the hydraulic pump 202 may be used to control the fluids between the prime mover 204, the hydraulically driven pump 203, and the tank 221. For example, the control system 222 may allow precise control of overall output of the modular pump skid 201, by controlling a motion profile across the individual hydraulic pump circuits (202, 203). Through the control system 222, a position, speed, and output of each stroke may be controlled to vary any kind of output from the modular pump skid 201 or just the individual hydraulic pump circuits (202, 203). Additionally, the control system 222 may be used for the compensation of a downed hydraulic pump circuit to be re-distributed to the other hydraulic pump circuits to maintain a smooth output flow from the modular pump skid 201.

Figure 7:
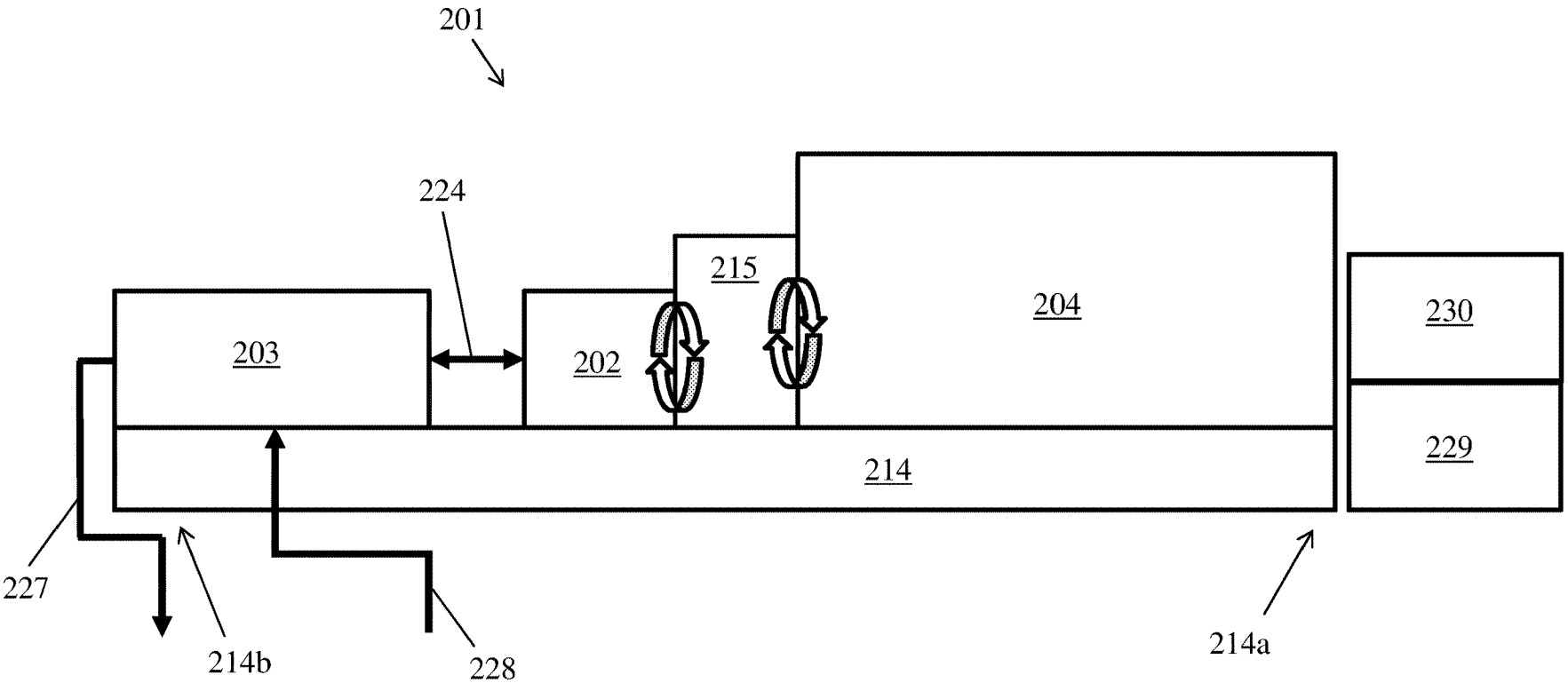
FIG. 7 illustrates a schematic view of a modular pump skid of the modular fracturing pump system of FIG. 4 in accordance with one or more embodiments of the present disclosure.

Now referring to FIG. 7, in one or more embodiments, FIG. 7 illustrates a schematic side view of the modular pump skid 201 as described in FIGS. 4-6. All the various components of the modular pump skid 201 may be removably mounted on a single base or chassis 214. The base or chassis 214 may be a trailer such as a flat-bed trailer to be connected to a truck for easy transport. The prime mover 204 may be at a first end 214*a* of the base or chassis 214. Adjacent to the prime mover 204, the pump drive 215 may be provided on the base or chassis 214 and positioned in between the prime mover 204 and the hydraulic pumps 202.

In some embodiments, the modular pump skid 201 may include one hydraulic pump 202 for each hydraulically driven pump 203. For example, the modular pump skid 201 may have five hydraulic pumps 202 each fluidly coupled to a corresponding hydraulically driven pump 203 removably mounted on a second end 214*b* of the base or chassis 214. While it is noted that five hydraulic pumps and five hydraulically driven pumps are used for an example, this is merely for example purposes only and any number of hydraulic pumps and hydraulically driven pumps may be used without departing from the scope of the present disclosure. Additionally, the five hydraulic pumps 202 may be in fluid communication with the five hydraulically driven pumps 203 via fluid conduits 224, such as hydraulic lines or hoses, extending from the five hydraulic pumps 202 to the five hydraulically driven pumps 203. In some embodiments, a connection block may be provided between the hydraulic pumps 202 and the hydraulically driven pumps 203 to avoid long and custom individual fluid conduits 224. The connection block may be used such that the fluid conduits 224 extend from the five hydraulic pumps 202 to the connection block and a second set of fluid conduits extend from the connection block to the five hydraulically driven pumps 203. In embodiments having an open loop configuration between the hydraulically driven pumps 203 and hydraulic pumps 202, a manifold (e.g., including one or more control valves) may be used in place of the connection block.

Embodiments disclosed herein may also operate using multiple open loop circuits rather than the multiple closed loop circuits described herein, where open loop circuit systems may have hydraulic pumps generate bulk pressure and flow, and a control valve to control flow to the hydraulic drive pump to create a motion profile. By using multiple open loop circuits, similar redundancy may be achieved, but may include increased complexity of components and increased fluid and cooling capacity needed. Although embodiments of the present disclosure may be configured in an open loop, a closed loop system configuration may advantageously reduce the amount of hydraulic fluid needed for operation, lower the weight of the system, and more efficiently use hydraulic fluid (compared with discharging energy as heat in an open loop system).

Additionally, the hydraulically driven pumps 203 may include a discharge line 227 and a feed line 228. The discharge line 227 may be at an end of the hydraulically driven pumps 203 distal to the hydraulic pumps 202 while the feed line 228 may be at an end of the hydraulically driven pumps 203 adjacent to the hydraulic pumps 202.

In one or more embodiments, the modular pump skid 201 may include a tank 229 and a radiator 230. For example, the tank 229 may be placed adjacent to the first end 214*a* of the base or chassis 214. In some embodiments, the tank 229 may be a hydraulic tank on a ground surface or on the base or chassis 214. The tank 229 may provide hydrostatic pressure to the prime mover 204. The radiator 230 may be disposed on top of the tank 229 to aid regulating a temperature of the prime mover 204 and other components of the modular pump skid 201.

According to embodiments of the present disclosure, modular pump skid systems may be configured to a pressure rating of any job requirement. For example, a main pressure rating limitation of the modular pump skid system may correspond with the wellheads. Furthermore, the modular pump skid systems may be rated up to 15,000 psi but is not limited to 15,000 psi (in some cases the pressure rating may go up to 20,000 psi or more). One skilled in the art will appreciate how various equipment within the modular pump skid system may have different pressure ratings. For example, the hydraulic pumps may have a pressure rating of 15,000 psi while the wellheads and the manifold skid may have a pressure rating of 10,000 psi. In some embodiments, the hydraulic pumps of the modular pump skid system may be pressure rated higher than the wellheads and the manifold skid, which may have pressures ratings from 5,000 psi up to 15000 psi, for example, and can change from job to job. In a non-limiting example, each long stroke cylinder, such as described above, may include dual-acting cylinders and provide 1000 horsepower per 48-inch stroke, with two strokes per cylinder, along with 12000 horsepower per modular pump skid system. Other combinations of HP, stroke, and number of cylinders per modular pump skid system may be used to provide a desired output pressure and/or flow rate without departing from the scope of the present disclosure.

According to embodiments of the present disclosure, fluid conduits of the modular pump skid system may have an inner diameter ranging from, for example, 4 inches to 8 inches. One skilled in the art will appreciate how the fluid conduits are not limited to the range of 4 inches to 8 inches and may be any desired inner diameter based on the job requirements. As such, the fluid conduits may be as small as ¾ inch (e.g., a 1 inch flow line) or as large as 30 inches (API 6A has regulations up to a 30 inch inner diameter, 3000 psi capacity). In such a case, the ends of the fluid conduits may have an upset section to transition from a larger inner diameter at the ends to a smaller inner diameter.

In one or more embodiments, the modular pump skid systems may be deployed in at least two ways. In a first way, modular pump skid system may be loaded onto a truck and unloaded on site via a crane, for instance. Once unloaded, the modular pump skid systems can be placed in proximity to one another and secured together, such as by bolts and/or hydraulics, to form a unitary pump structure. The end portions (inlet(s) and outlet(s)) of fluid conduits of the modular pump skid system may be connected together by any known mechanisms, including flanges, clamps, grayloc hubs, KL4 connectors, etc. In some embodiments, modular pump skid systems may be removably mounted and deployed on flatbeds. The fluid conduit connections between multiple modular pump skid systems on a truck may be made up before the trucks are driven to the site. In a non-limiting example, the modular pump skid system may be modularized and deployed on connectable skids to reduce the number of connections to other equipment. Additionally, the modular pump skid system may be sized and weighted to be transportable down a department of transportation ("DOT") regulated road. For example, in some embodiments, the modular pump skid system may be sized and weighted to meet shipping truck width/length requirements (e.g., up to 8½ feet wide and up to 42 feet long). Overall, a modular pump skid system according to embodiments of the present disclosure may minimize product engineering, risk associated with non-uniform connections, reduction of assembly time, hardware cost reduction, and weight and envelope reduction.

Implementations herein for operating the modular pump skids (201, 201*a*, 201*b*, 201*c*, 201*d*) may be implemented on a computing system (e.g., control system 222 as described in FIG. 6) coupled to a controller. The computing system may know a position of the hydraulically driven pumps (203) at all times; have finite control of the closed loop; and be able to have the hydraulically driven pumps (203) speed up, slow down, stop, and reverse in an extremely smooth and non-turbulent way. Additionally, when having multiple hydraulic pump circuits (202, 203) on one modular pump skid (201, 201*a*, 201*b*, 201*c*, 201), the computing system may utilize horsepower from the prime mover (204) more effectively and efficiently to provide a smooth, non-pulsating output flow and pressure from the modular pump skid (201, 201*a*, 201*b*, 201*c*, 201) to the wellhead (205).

In some embodiments, inputs for the computing system may be a swash plate position, hydraulic bearing/operational condition, hydraulic suction and inlet pressure, hydraulic fluid temperature, linear variable differential transformer (LVDT) position from the cylinder on where the cylinder is at any given moment (or some other position sensing solution), frac pump suction pressure and inlet pressure, vibration monitoring, and various other operational parameters of the modular pump skid (201, 201*a*, 201*b*, 201*c*, 201). The closed loop may provide the modular pump skid (201, 201*a*, 201*b*, 201*c*, 201) with the benefits of being able to generate only what fluids are needed for a certain motion profile for each hydraulically driven pumps (203). In contrast, open loops may be more of a "choke" system where the control valve regulates the flow to get a motion profile and any flow not used is rejected as heat.

Figure 8:
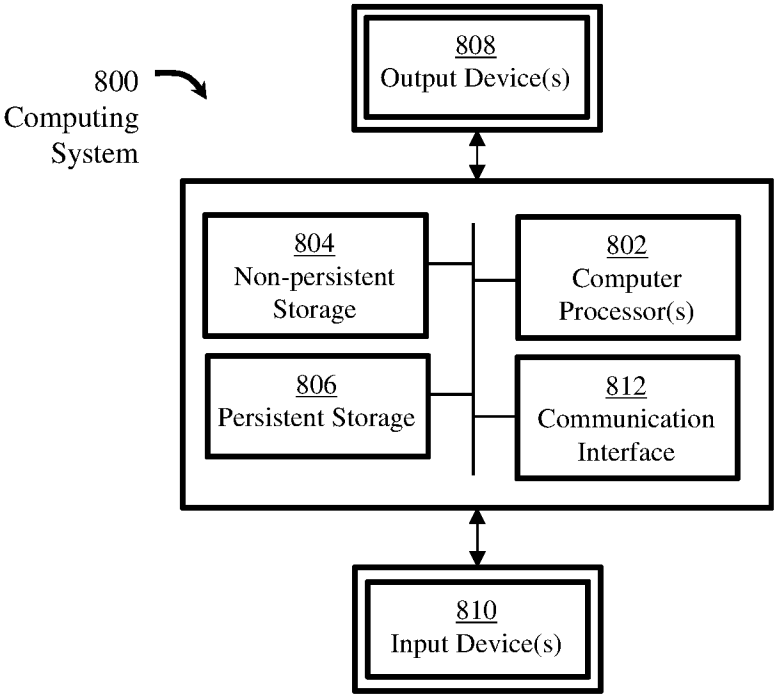
FIG. 8 is a schematic diagram of a computing system in accordance with one or more implementations of the present disclosure.

Any combination of mobile, desktop, server, router, switch, embedded device, or other types of hardware may be used with the modular pump skids (201, 201*a*, 201*b*, 201*c*, 201*d*). For example, as shown in FIG. 8, the computing system 800 may include one or more computer processors 802, non-persistent storage 804 (e.g., volatile memory, such as random access memory (RAM), cache memory), persistent storage 806 (e.g., a hard disk, an optical drive such as a compact disk (CD) drive or digital versatile disk (DVD) drive, a flash memory, etc.), a communication interface 812 (e.g., Bluetooth interface, infrared interface, network interface, optical interface, etc.), and numerous other elements and functionalities. It is further envisioned that software instructions in a form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. For example, the software instructions may correspond to computer readable program code that, when executed by a processor(s), is configured to perform one or more embodiments of the disclosure.

The computing system 800 may also include one or more input devices 810, such as a touchscreen, keyboard, mouse, microphone, touchpad, electronic pen, or any other type of input device. Additionally, the computing system 800 may include one or more output devices 808, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 802, non-persistent storage 804, and persistent storage 806. Many different types of computing systems exist, and the aforementioned input and output device(s) may take other forms.

The computing system 800 of FIG. 8 may include functionality to present raw and/or processed data, such as results of comparisons and other processing. For example, presenting data may be accomplished through various presenting methods. Specifically, data may be presented through a user interface provided by a computing device. The user interface may include a graphic user interface (GUI) that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model. For example, a GUI may first obtain a notification from a software application requesting that a particular data object be presented within the GUI. Next, the GUI may determine a data object type associated with the particular data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device. Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A modular pump skid, comprising:

a base;

a prime mover mounted on the base;

one or more hydraulic pump circuits removably mounted on the base and operationally coupled to the prime mover, wherein each hydraulic pump circuit comprises:

a hydraulic pump operationally coupled to the prime mover; and a hydraulically driven pump fluidly coupled to the hydraulic pump, wherein the hydraulic pump and the hydraulically driven pump are in a closed loop; and a control system configured to redistribute an unused horsepower, when one of the one or more hydraulic pump circuits breaks down, to one or more operating hydraulic pump circuits by increasing a horsepower of the one or more operating pump circuits not broken down with the unused horsepower, wherein each hydraulic pump circuit is independent of other hydraulic pump circuits.

2. The modular pump skid of claim 1, further comprising at least two of the hydraulic pump circuits removably mounted on the base and operationally coupled to the prime mover.

3. The modular pump skid of claim 1, wherein the hydraulically driven pump is long stroke cylinder comprising a plunger and a piston, and wherein the closed loop comprises: a first side of a piston chamber of the hydraulically driven pump fluidly connected to a first side of the hydraulic pump and a second side of the piston chamber fluidly connected to a second side of the hydraulic pump.

4. The modular pump skid of claim 3, wherein the hydraulic pump directs fluids between the first and second sides of the piston chamber to move the piston and drive the hydraulically driven pump.

5. The modular pump skid of claim 1, further comprising a pump drive operationally coupled between the hydraulic pump and the prime mover.

6. The modular pump skid of claim 5, wherein the pump drive comprises one inlet gear coupled to the prime mover and a corresponding number of outlet gears coupled to each hydraulic pump.

7. The modular pump skid of claim 1, further comprising a swash plate, wherein the control system is configured to operate the swash plate.

8. The modular pump skid of claim 1, wherein the base is a trailer.

9. The modular pump skid of claim 1, wherein the prime mover is a single speed turbine.

10. A system, comprising:

one or more modular pump skids, comprising:

a prime mover mounted on a base;

one or more hydraulic pump circuits removably mounted on the base and operationally coupled to the prime mover, wherein each hydraulic pump circuit comprises:

a hydraulic pump; and a hydraulically driven pump fluidly coupled to the hydraulic pump, a control system configured to redistribute an unused horsepower, when one of the one or more hydraulic pump circuits breaks down, to one or more operating hydraulic pump circuits by increasing a horsepower of the one or more operating pump circuits not broken down with the unused horsepower;

wherein each hydraulic pump circuit is in a closed loop independent of other hydraulic pump circuits;

one or more high-pressure fluid conduits coupled to the hydraulically driven pump; and a fluid manifold coupled to a well, wherein the one or more high-pressure fluid conduits is fluidly coupled to the fluid manifold, wherein the hydraulically driven pump is configured to inject fluids into the well.

11. The system of claim 10, further comprising at least two modular pump skids of the one or more modular pump skids fluidly coupled the fluid manifold.

12. The system of claim 10, further comprising a hydraulic excess tank fluidly coupled to the hydraulic pump.

13. The system of claim 10, further comprising one or more low-pressure conduits coupled to the hydraulically driven pump.

14. The system of claim 13, further comprising a frac blender fluidly coupled to the one or more low-pressure conduits to feed the hydraulically driven pump.

15. The system of claim 10, further comprising a hydraulic tank coupled to the prime mover to provide hydraulic pressure to drive the hydraulic pump.

16. The system of claim 15, further comprising a radiator disposed on top of the hydraulic tank configured to regulate a temperature of the prime mover, wherein the control system is configured to monitor and regulate a temperature of the radiator.

17. The system of claim 10, further comprising a controller, wherein the control system is coupled to the controller to automatically operate the modular pump skid.

18. The system of claim 10, wherein the one or more modular pump skids further comprises a swash plate, wherein the control system is configured to operate the swash plate.

* * * * *